US005502975A

United States Patent [19]

Brickley et al.

[11] Patent Number: 5,502,975

[45] Date of Patent: Apr. 2, 1996

[54] AIR CONDITIONING SYSTEM

[75] Inventors: Stephen C. Brickley, Newbury; Nancy Banks, Beverly, both of Mass.; Larry Klekar, Garden Ridge, Tex.

[73] Assignee: Munters Corporation, Ft. Myers, Fla.

[21] Appl. No.: 252,216

[22] Filed: Jun. 1, 1994

[51] Int. Cl.[6] ..... F25D 17/06

[52] U.S. Cl. ..... 62/94; 62/271

[58] Field of Search ..... 62/94, 271

[56] References Cited

U.S. PATENT DOCUMENTS

| | | | |
|---|---|---|---|
| 2,926,502 | 3/1960 | Munters et al. | 62/94 |
| 2,968,165 | 1/1961 | Norback | 62/94 |
| 3,009,684 | 11/1961 | Munters | 62/94 X |
| 3,247,679 | 4/1966 | Meckler | 62/94 X |
| 4,594,860 | 6/1986 | Coellner et al. | 62/271 |
| 5,170,633 | 12/1992 | Kaplan | 62/94 |
| 5,353,606 | 10/1994 | Yoho et al. | 62/94 X |

FOREIGN PATENT DOCUMENTS

| | | | |
|---|---|---|---|
| 688082 | 6/1964 | Canada | 62/94 |

*Primary Examiner*—William E. Tapolcai

*Attorney, Agent, or Firm*—Fitzpatrick, Cella, Harper & Scinto

[57] ABSTRACT

A method and apparatus for conditioning air for an enclosure is disclosed in which a first stream of outside ambient air is dried in a desiccant wheel dehumidifier and cooled in a heat exchanger while maintaining the moisture content thereof relatively unchanged; thereafter the air stream is cooled by passing the same over a cooling element whose surface temperature under normal operating conditions is higher than the dew point of the cooled and dried air leaving the heat exchanger. The thus cooled first outside air stream is then supplied to the enclosure while return air is withdrawn from the enclosure and supplied to the heat exchanger to pass in heat exchange relation to the dried first outside air stream in order to reduce the temperature of the first outside air stream in the heat exchanger while increasing the temperature of the enclosure return air which can be either exhausted to the atmosphere or used to reactivate the desiccant wheel before being returned to the atmosphere.

13 Claims, 3 Drawing Sheets

FIG. 2

| | | A | B | C | D | E | F | G | H | I | J | K | L | M | N | P |
|---|---|---|---|---|---|---|---|---|---|---|---|---|---|---|---|---|
| SUMMER | AIR FLOW: SCFM | 10000 | 10000 | 10000 | 10000 | 10000 | 8000 | 8000 | 2600 | 400 | 400 | --- | --- | 2600 | 3000 | 3000 |
| | TEMP: F DB | 90 | 125 | 95 | 74 | 76 | 75 | 111 | 90 | 90 | 226 | -- | -- | 254 | 250 | 120 |
| | HUMIDITY RATIO: GR/LB | 110 | 66 | 66 | 66 | 66 | 70 | 70 | 110 | 110 | 65 | -- | -- | 110 | 104 | 256 |
| WINTER | AIR FLOW: SCFM | 10000 | 10000 | 10000 | 10000 | 10000 | 8000 | 8000 | ------ | ---- | --- | -- | -- | ---- | ----- | ----- |
| | TEMP: F DB | 10 | 10 | 39 | 39 | 70 | 70 | 34 | ---- | ---- | ---- | -- | -- | ----- | ----- | ------ |

AIR CONDITIONING SYSTEM

BACKGROUND OF THE INVENTION

1. Field of the Invention

The present invention relates generally to air conditioning systems and more particularly to air conditioning systems which use desiccant wheels for dehumidification.

2. The Background of the Invention

Air conditioning systems for cooling air in an enclosed space typically must overcool the air in order to achieve adequate dehumidification. The result of overcooling is that the air must be reheated to control dry bulb temperature. It has been found that by the use of desiccant systems depressed lower humidity levels can be achieved while providing savings in the overall air conditioning operation.

Air conditioning systems using desiccant wheel dehumidifiers have been disclosed heretofore in the art in, for example, U.S. Pat. Nos. 2,926,502 to Carl G. Munters et al.; 2,968,165 to Per G. Norback; 3,009,684 to Carl G. Munters; and 4,594,860 Coellner et al. These systems generally treat room air in its entirely and return it to the room after treatment. The '860 Patent suggests the use of some make up or outside air into the system.

In accordance with the present invention an air conditioning system is disclosed in which all of the return air in the enclosure is exhausted into the atmosphere, but is used first in the process in order to treat outside air being introduced into the enclosure for air exchange purposes.

Heretofore, in air conditioning systems using only outside air for cooling, very large air conditioning systems have been provided in order to cool the air sufficiently and also to dehumidify the same through condensation in the air conditioner itself. Such systems are relatively expensive to install initially and are very expensive to operate due to high power requirements.

It is an object of the present invention to provide an improved air conditioning system based upon desiccant technology.

Yet another object of the present invention is to provide an improved air conditioning system which is relatively inexpensive to construct and to operate as compared to prior art systems.

Yet another object of the present invention is to provide a desiccant based air conditioning system which is reliable in operation.

SUMMARY OF THE INVENTION

In accordance with an aspect of the present invention an air conditioning system for an enclosure such as a room or the like is provided in which outside air is supplied to a desiccant wheel dehumidifier which dries the air while raising its temperature. The dried and slightly heated outside air is then supplied from the desiccant wheel dehumidifier to a heat exchanger. Return air from the room or enclosure is also supplied to the heat exchanger, which may be a heat pipe, in order to reduce the temperature of the outside air in the heat exchanger while increasing the temperature of the enclosure return air. The moisture content of the outside air remains relatively constant while passing through the heat exchanger in this step.

The outside air from the heat exchanger is then supplied to an air conditioner device which cools the outside air further by passing it over a cooling element whose surface temperature, under normal operation conditions, is higher than the dew point of the outside air from the heat exchanger. As a result of the use of the desiccant wheel, the air supplied to the air conditioner is relatively dry so the air conditioner can be operated at higher temperatures while avoiding condensation in the air conditioner. It thus operates in its most efficient mode.

The outside air cooled in the air conditioner is supplied to the enclosure. The room air from the heat exchanger may be exhausted to the atmosphere or supplied to the desiccant wheel for use in reactivating the wheel.

Applicants have found that an air conditioner system constructed in accordance with the present invention is less expensive to construct and to maintain than an air conditioning system using only an air conditioner device. By this system the capacity of the air conditioner unit can be substantially reduced as compared to previously proposed systems because of the reduction in moisture content of the air as a result of the use of the desiccant wheel to treat the outside air being supplied to the enclosure. The system will cost less to purchase initially and costs less to operate. As an additional advantage the air quality is improved because the higher ventilation rate of the system of the invention dilutes indoor air contaminants. Another advantage of the system as compared to conventional air conditioning systems is that in a conventional system an air conditioner will saturate the air stream and create condensation which produces sites for bacteria growth in the system. Because the present invention avoids condensation, the danger of bacteria growth is avoided. In addition, the air leaving the system is at below 70% RH which prevents bacteria growth in the duct work or the air distribution system.

In one example, a conventional air conditioning system for cooling outside air may require a 325 ton air conditioner. With the present invention, using a desiccant wheel system, the required air conditioner need only be 145 tons. Thus the size of air conditioner and the power consumption of the system is reduced by more than one half.

The advantages of the present invention are enhanced by the use of the enclosure return air in the air conditioning process to cool the dried air from the desiccant wheel thereby conserving energy that has been previously used to cool previously air supplied to the enclosure.

In the preferred embodiment of the invention as described hereinafter a heat pipe system is used for the heat exchanger; however other heat exchangers such as for example a heat exchange wheel as is known in the art could be used. Heat pipes provide a greater degree of design flexibility for packaging the unit and avoids the use of moving parts.

The above and other objects, features advantages of this invention will be apparent in the following detailed description of illustrative embodiments thereof, which is to be read in conjunction with the accompanying drawing wherein:

BRIEF DESCRIPTION OF DRAWING

FIG. 2 is a chart showing an example of operating conditions within the system of the present invention wherein outside air temperature is 90° Fahrenheit and enclosure return air is at 75° Fahrenheit.

DETAILED DESCRIPTION

Figure 1:
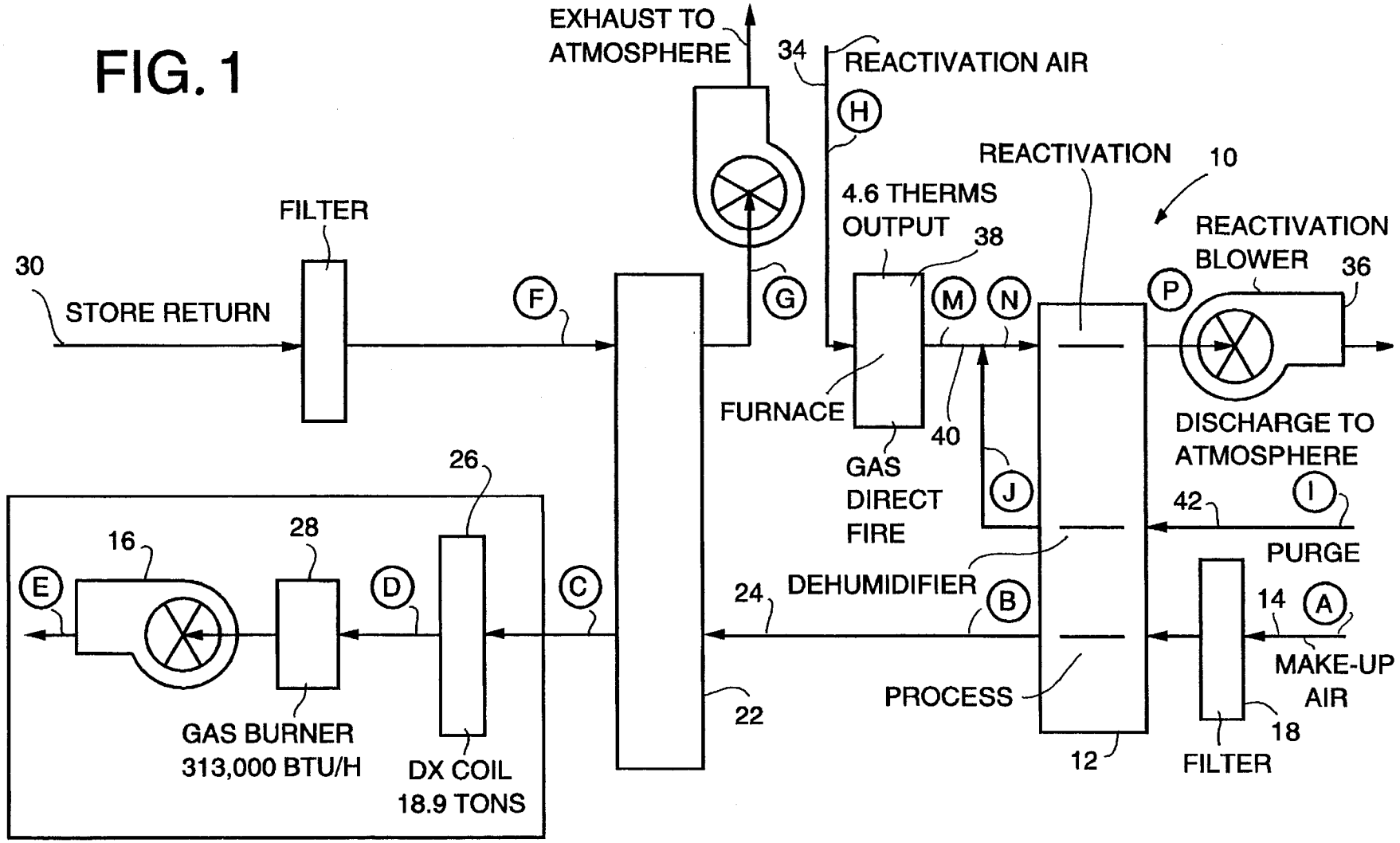
FIG. 1 is the schematic view of an air conditioning system constructed in accordance with the present invention.

Referring now the drawing in detail, and initially to FIG. 1 thereof, an air conditioning system 10 constructed in accordance with the present invention is illustrated. This system includes a desiccant wheel 12 which is of known construction such as has been provided in the past by Cargocaire Engineering Corporation and by Munters Corporation. Such dehumidifiers typically are formed from a roll of corrugated material which provides a plurality of passageways in the wheel-like structure. The corrugated material is coated with lithium chloride or other desiccant materials in a known manner. The wheel is rotated through the series of separated air streams to remove moisture from one air stream while giving up the moisture to a separate air stream and thereby being reactivated.

In accordance with the present invention ambient or outside air is supplied to the system 10 through an intake duct 14 or the like under the influence of a blower 16.

The outside air in this first stream of outside air is preferably passed through a conventional dust filter or the like 18 before entering the desiccant wheel 12. As is known in the art the wheel is rotated slowly about its longitudinal axis by a motor (not shown) in the conventional manner. As the air passes through the desiccant wheel moisture is removed from the air and, as a result, the air's temperature is increased.

The temperature conditions of various stages of the process are depicted on the graph of FIG. 2 for one embodiment of the invention wherein the air flow induced by the blower 16 is 10,000 standard cubic feet per minute, with outside air temperature being 90° Fahrenheit and having a humidity ratio of 110 grains per pound. These are the conditions of the ambient air stream at point A in FIG. 1. As seen from the chart in FIG. 2, after the air passes through the desiccant wheel, at point B, its temperature has been raised to 125° Fahrenheit but its humidity ratio has been decreased to 66 gr/lb.

From the desiccant wheel, the now slightly heated and dried first stream of outside air is passed to a heat exchanger 22. As mentioned above heat exchanger 22 is preferably formed of heat pipes. The heat pipes can be of known construction and are generally available in the heat exchanger art, therefore they need by described here in detail. While heat pipes are preferred, it is also possible to use heat exchanger wheels such are known in the art.

The slightly heated and dried first outside air stream flows from the desiccant wheel 12 through a duct 24 or the like to the heat exchanger where its temperature is reduced, without any material exchange in its moisture content. In the illustrative embodiment the temperature of the air is reduced from 125° Fahrenheit to 95° Fahrenheit at point C. From there, the air is supplied to an air conditioner 26, which also is of known construction. The air conditioner may be a conventional electrically operated refrigerant based air conditioner having cooling coils over which the air is passed in heat exchange relationship. Because the air has been dried in the desiccant wheel it is possible to operate the air conditioner unit at higher temperatures than have been previously used in the art because the air conditioner does not have to produce any dehumidification. Indeed, the air conditioner operates at a temperature which is higher than the dew point temperature of the air being treated thereby avoiding formation of condensation on the condensation coils. Condensation on the coils would decrease the efficiency of the air conditioner and its ability to cool the air. It also produces undesirable sites for bacterial growth. Of course, while the air conditioner operates at the desired temperature above the dew point of the air flowing from the heat during normal on-line operating conditions, it will be understood by those skilled in the art that during initial start up of the air conditioner, before it reaches a steady state condition, there may be some temperature variation.

As a result of the passage of the air through air conditioner 26, its temperature is decreased to 74° Fahrenheit without any change in the moisture content thereof. Blower 16 then supplies the thus cooled air to the room enclosure.

In the illustrative embodiment of FIG. 1, a gas burner or furnace 28 is provided in the air stream between air conditioner 26 and blower 16. This burner is not used in the air conditioning mode of operation of the apparatus of FIG. 1. The burner is used when heated air is required and the air conditioning system is not operating. When the normal air conditioning mode of the present invention the air passes untreated through the burner system.

In accordance with a feature of the present invention, return air from the enclosure is supplied through the duct system 30 schematically illustrated in FIG. 1 first through a filter 32 of conventional construction and then through heat exchanger 22. The enclosure return air has a relatively low temperature as a result of the prior cooling in the system. It would be uneconomical simply to exhaust this air into the atmosphere. In accordance with the present invention, this cool air is used in the heat exchanger to cool the first outside air stream 24 in the heat exchanger. Thus the return air is passed across one end of the heat pipes in order to remove heat therefrom, thereby cooling air stream 24. As illustrated in FIG. 2, the return air has a temperature of 75° Fahrenheit and a humidity ratio of 70 gr/lbs. After leaving the heat exchanger its temperature has been raised to 111° F at point G. At this point, the heated return air can be exhausted to the atmosphere. If necessary, the temperature of the return air can be reduced before passing through the heat exchanger by first passing it through an evaporative cooler.

In the embodiment of the invention illustrated in FIG. 1, desiccant wheel 12 is reactivated through the use of a second outside air stream supplied through an inlet duct system 34 under the influence of the reactivation blower 36. That blower draws outside air into the system and passes it through first a conventional gas fired furnace 38, such as is available through Cargocaire Corporation. The furnace increases the temperature of the outside air which has, in the illustrative embodiment, a temperature of 90° F. This air is supplied through the duct system to the desiccant wheel 12 in order to reactivate the wheel in the known manner. The heated air removes moisture from the wheel and is then discharged to the atmosphere through the blower 36.

In accordance with another feature of the present invention another stream of outside air is introduced into the process through the inlet duct system 42 under the influence of blower 36. This stream of outside air, which also has a temperature of 90° Fahrenheit, is passed through another segment of the dehumidifier as it rotates before that segment enters the air stream supplied through the duct 40. The passage of this third outside air stream through the dehumidifier serves to cool the dehumidifier before sorption. The air temperature is raised to 226° Fahrenheit in this process. The air in this third steam is than mixed with the heated air from furnace 38 and all of this is supplied to the desiccant wheel in the reactivation section thereof to eliminate moisture from the wheel.

Thus at point M the mixed air streams have a temperature of 250° Fahrenheit and a joint moisture content of 104 gr/lb.

After passing through the reactivation section of the desiccant wheel the temperature of the air drops to 120° F. but its moisture content has increased to 256 gr/lb.

Figure 3:
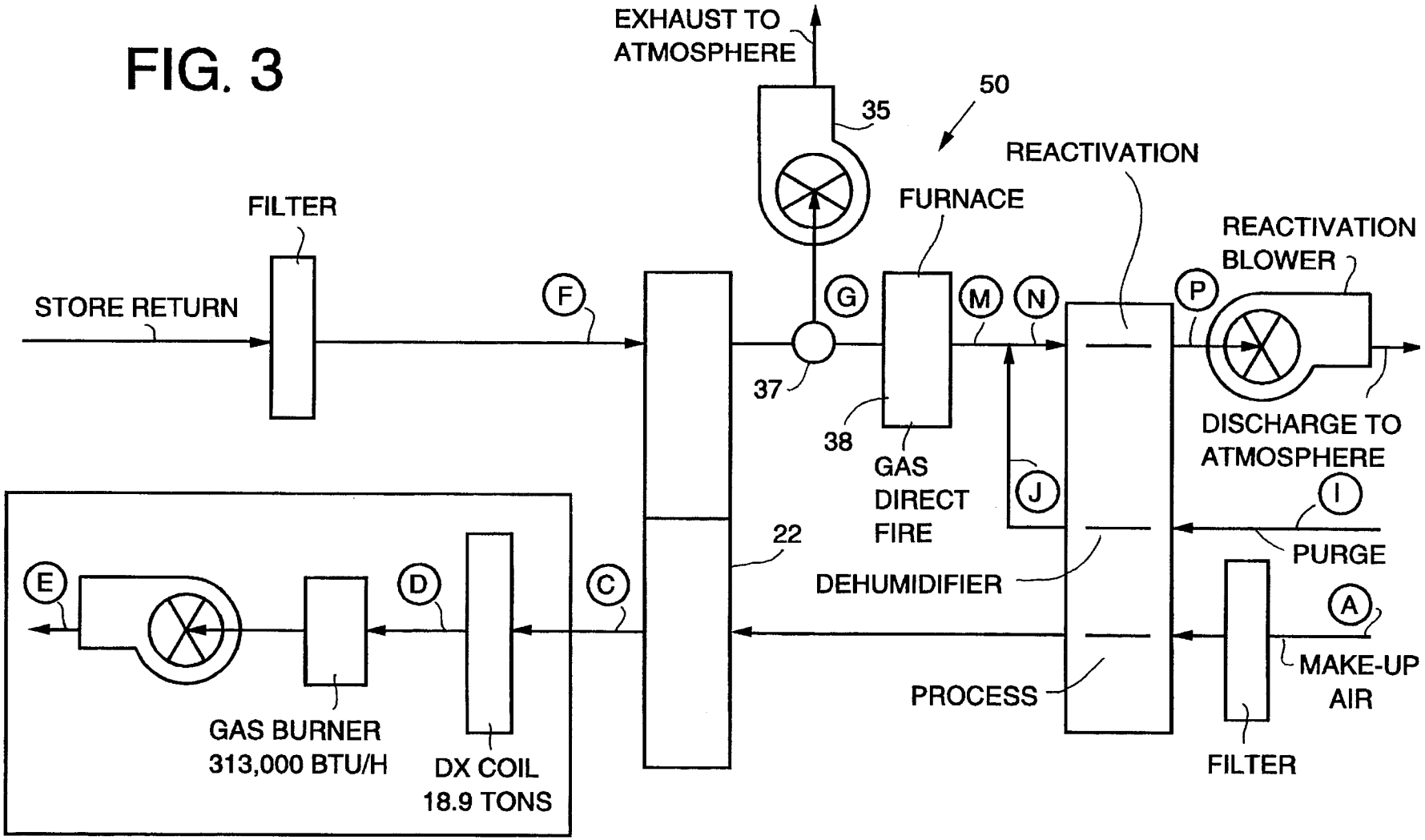
FIG. 3 is a view similar to FIG. 1 of another embodiment of the invention wherein return air is used to reactivate the desiccant wheel.

Another embodiment of the present invention illustrated in FIG. 3 wherein like reference numerals have been used to identify like parts. The system 50 of FIG. 3 is substantially identical to FIG. 1 except that in this embodiment the enclosure return air is supplied to the furnace 38 for use in the reactivation process rather than being completely exhausted into the atmosphere. The blower 35 discharges some of the air to the atmosphere, but a control valve 37 or the like is provided to divert some (or all) of the air to the furnace where it is heated. Since the temperature of the return air has already been increased in heat exchanger 22, it is more efficient to use that heated return air in the furnace than to use outside air. Thus less energy consumption is required by the furnace. Otherwise the systems operate essentially identically.

The air conditioner system of the present invention represents an improved desiccant wheel based system with substantial efficiencies both in original installation expenses and in operation. The size of the air conditioner and furnace needed in the systems are reduced.

As described above these systems are used for cooling air supplied to the enclosure. If it is necessary to supply heated air to the enclosure, the system operates as described except that instead of the air conditioner 26 being operative, the gas burner is operative. In that mode of operation heat pipe 22 serves to recover heat from the return air in duct 32 and preheat the air in duct 24 before it enters furnace 26.

Although the illustrative embodiments of the present invention have been described herein with reference to the accompanying drawings, it is to be understood that the invention is not limited to those precise embodiments, but that various changes in modifications can be effected therein by those skilled in the art without departing from the scope or spirit of this invention.

What is claimed is:

1. The method of conditioning air for an enclosure which comprises the steps of:

1) supplying outside air to a desiccant wheel dehumidifier;

2) drying said air in the desiccant wheel dehumidifier while increasing its temperature;

3) supplying said heated and dried outside air to a heat exchanger while also supplying return air from said enclosure to said heat exchanger;

4) reducing the temperature of said outside air in said heat exchanger while increasing the temperature of said enclosure return air and maintaining the humidity of the outside air relatively constant;

5) supplying the outside air from said heat exchange to an air conditioner;

6) cooling said outside air in said air conditioner by passing the outside air over a cooling element whose surface temperature under normal operating conditions is higher than the dew point of the outside air from the heat exchanger;

7) supplying the outside air from the air conditioner to the enclosure;

8) exhausting the room air from the heat exchanger to the atmosphere;

9) heating a second stream of outside air 10) supplying the heated second stream of outside air to the desiccant wheel to reactivate the desiccant wheel and remove moisture therefrom;

11) supplying a third stream of outside air to said desiccant wheel prior to the supply of said second stream thereto for cooling the wheel while increasing the temperature of said third stream of outside air; and 12) mixing the heated third stream of outside air with the heated second stream of outside air before said second stream of outside air is supplied to the desiccant wheel.

2. The method of conditioning air for an enclosure as defined in claim 1, including the step of exhausting said mixed second and third streams of outside air to the atmosphere after they have passed through the desiccant wheel and reactivated the desiccant wheel.

3. The method of conditioning air for an enclosure which comprises the steps of:

1) supplying outside air to a desiccant wheel dehumidifier;

2) drying said air in the desiccant wheel dehumidifier while increasing its temperature;

3) supplying said heated and dried outside air to a heat exchanger while also supplying return air from said enclosure to said heat exchanger;

4) reducing the temperature of said outside air in said heat exchanger while increasing the temperature of said enclosure return air and maintaining the humidity of the outside air relatively constant;

5) supplying the outside air from said heat exchanger to an air conditioner;

6) cooling said outside air in said air conditioner by passing the outside air over a cooling element whose surface temperature under normal operating conditions is higher than the dew point of the outside air from the heat exchanger;

7) supplying the outside air from the air conditioner to the enclosure;

8) exhausting the room air from the heat exchanger to the atmosphere;

9) heating the enclosure return air from said heat exchanger;

10) supplying the heated enclosure return air to the desiccant wheel to reactivate the desiccant wheel and remove moisture therefrom;

11) supplying a second stream of outside air to said desiccant wheel prior to the supply of said second stream thereto for cooling the wheel while increasing the temperature of said second stream of outside air; and 12) mixing the heated second stream of outside air with the heated enclosure return air before the heated enclosure return air is supplied to the desiccant wheel.

4. The method of conditioning air for an enclosure as defined in claim 3, including the step of exhausting said mixed second stream of outside air and said heated enclosure return air to the atmosphere after they have passed through the desiccant wheel and reactivated the desiccant wheel.

5. The method of conditioning air for an enclosure which comprises the steps of:

1) drying a first stream of outside ambient air in a desiccant wheel dehumidifier;

2) cooling the dried first outside air stream from the dehumidifier in a heat exchanger while maintaining the moisture content thereof relatively unchanged;

3) further cooling the cooled and dried first outside air stream by passing the same over a cooling element whose surface temperature under normal operating conditions is higher than the dew point of the cooled and dried first outside air stream leaving the heat exchange;

4) supplying the cooled first outside air stream to said enclosure;

5) passing enclosure return air in heat exchange relation to said dried first outside air stream in said heat exchanger to reduce the temperature of said first outside air stream increasing the temperature of said enclosure return air;

6) exhausting the heated enclosure return air to the atmosphere;

7) heating a second stream of outside air;

8) supplying the heated second stream of outside air to the desiccant wheel to reactivate the desiccant wheel and remove moisture therefrom;

9) supplying a third stream of outside air to said desiccant wheel prior to the supply of said second stream thereto for cooling the wheel while increasing the temperature of said third stream of outside air; and 10) mixing the heated third stream of outside air with the heated second stream of outside air before said second stream of outside air is supplied to the desiccant wheel.

6. The method of conditioning air for an enclosure as defined in claim 5, including the step of exhausting said mixed second and third streams of outside air to the atmosphere after they have passed through the desiccant wheel and reactivated the desiccant wheel.

7. The method of conditioning air for an enclosure which comprises the steps of:

1) drying a first stream of outside ambient air in a desiccant wheel dehumidifier;

2) cooling the dried first outside air stream from the dehumidifier in a heat exchanger while maintaining the moisture content thereof relatively unchanged;

3) further cooling the cooled and dried first outside air stream by passing the same over a cooling element whose surface temperature under normal operating conditions is higher than the dew point of the cooled and dried first outside air stream leaving the heat exchange;

4) supplying the cooled first outside air stream to said enclosure;.

5) passing enclosure return air in heat exchange relation to said dried first outside air stream in said heat exchanger to reduce the temperature of said first outside air stream increasing the temperature of said enclosure return air;

6) exhausting the heated enclosure return air to the atmosphere;

7) heating the enclosure return air from said heat exchanger.;

8) supplying the heated enclosure return air to the desiccant wheel to reactivate the desiccant wheel and remove moisture therefrom;

9) supplying a second stream of outside air to said desiccant wheel prior to the supply of said second stream thereto for cooling the wheel while increasing the temperature of said second stream of outside air; and 10) mixing the heated second stream of outside air with the heated enclosure return air before the heated enclosure return air is supplied to the desiccant wheel.

8. The method of conditioning air for an enclosure as defined in claim 7, including the step of exhausting said mixed second stream of outside air and said heated enclosure return air to the atmosphere after they have passed through the desiccant wheel and reactivated the desiccant wheel.

9. Apparatus for conditioning air for an enclosure comprising means for supplying outside ambient air in a first outside air stream to an enclosure, desiccant wheel means for reducing the moisture content of said first outside air stream; heat exchange means upstream of said desiccant wheel means for initially cooling said first outside air stream without material alteration of its moisture content; air conditioning means upstream of said heat exchanger for further cooling of said first outside air stream without materially effecting its moisture content, said air condition means having a cooling element whose surface temperature at normal operating conditions is greater than the dew point of the first outside air stream leaving the heat exchanger; and means for supplying return air from the enclosure to the heat exchanger for use in the heat exchanger to reduce the temperature of said first outside air stream leaving the desiccant wheel while increasing the temperature of said enclosure return air; means for discharging the heated return air from said heat exchanger to the atmosphere; said heat exchanger comprising at least one heat pipe; and means for heating a second stream of outside air and supplying it to the desiccant wheel means for reactivating the desiccant wheel to remove moisture therefrom.

10. Apparatus as defined in claim 9 including means for supplying a third stream of outside air to the desiccant wheel prior to the supply of said second stream thereto for cooling the wheel while increasing the temperature of said third stream of outside air.

11. Apparatus as defined in claim 10 including means for mixing the heated third stream of outside air with the heated second stream of outside air before the second stream of outside air is supplied to the desiccant wheel.

12. Apparatus for conditioning air for an enclosure comprising means for supplying outside ambient air in a first outside air stream to an enclosure, desiccant wheel means for reducing the moisture content of said first outside air stream; heat exchange means upstream of said desiccant wheel means for initially cooling said first outside air stream without material alteration of its moisture content; air conditioning means upstream of said heat exchanger for further cooling of said first outside air stream without materially effecting its moisture content, said air condition means having a cooling element whose surface temperature at normal operating conditions is greater than the dew point of the first outside air stream leaving the heat exchanger; means for supplying return air from the enclosure to the heat exchanger for use in the heat exchanger to reduce the temperature of said first outside air stream leaving the desiccant wheel while increasing the temperature of said enclosure return air; means for discharging the heated return air from said heat exchanger to the atmosphere; said heat exchanger comprising at least one heat pipe; means for heating a second stream of outside air and supplying it to the desiccant wheel means for reactivating the desiccant wheel to remove moisture therefrom; means for heating return air leaving the heat exchanger and supplying it to the desiccant wheel means before being discharged to the atmosphere, thereby to reactivate the desiccant wheel and remove moisture therefor; and means for supplying a second stream of outside air to the desiccant wheel prior to the supply of the heated enclosure return air to the wheel for cooling the wheel while increasing the temperature of the second stream of outside air.

13. Apparatus as defined in claim 12 including means for mixing the second stream of outside air with the heated enclosure return air leaving the heat exchanger before said heated enclosure return air is supplied to the desiccant wheel.

* * * * *